United States Patent [19]

Coulon

[11] Patent Number: 4,584,081

[45] Date of Patent: Apr. 22, 1986

[54] APPARATUS FOR DEPOSITING METAL ON THE RUBBING PARTS OF A TURBINE ROTOR

[75] Inventor: André Coulon, Bessancourt, France

[73] Assignee: Alsthom-Atlantique, Paris, France

[21] Appl. No.: 727,635

[22] Filed: Apr. 26, 1985

[30] Foreign Application Priority Data

Apr. 26, 1984 [FR] France ..... 84 06589

[51] Int. Cl.[4] ..... C25D 17/00; C25D 17/12; C25D 21/10

[52] U.S. Cl. ..... 204/272; 204/273; 204/277

[58] Field of Search ..... 204/25, 212, 218, 272, 204/273, 275, 277

[56] References Cited

U.S. PATENT DOCUMENTS

| | | | |
|---|---|---|---|
| 3,259,049 | 7/1966 | Uithoven | 204/277 |
| 3,503,856 | 3/1970 | Blackmore | 204/277 |
| 4,303,481 | 12/1981 | Mortier | 204/272 |

*Primary Examiner*—T. M. Tufariello

*Attorney, Agent, or Firm*—Sughrue, Mion, Zinn, Macpeak and Seas

[57] ABSTRACT

The apparatus is particularly intended for depositing chromium on the bearing surfaces of bearings and end stops of turbine rotors made of chromium steel in order to obtain a good coefficient of friction thereon. The apparatus comprises a vat (1) having a vertical axis 00′ constituted by a cylindrical portion (2) terminated by a conical portion (3), said vat (1) being filled with electrolyte, first means (7, 8) disposed near the top of said vat (1) for feeding the vat (1) with electrolyte, second means (4) situated at the bottom of the vat (1) for emptying the electrolyte, third means (32, 33) situated between the second means (4) and the first means (7, 8) for regenerating and circulating the electroylte, fourth means (15) for supporting a curtain of anodes (17) made of the metal to be deposited and for rotating the electrolyte about the axis 00′, and fifth means (29) for applying current of given polarity to the curtain of anodes (17). The apparatus is characterized in that said fourth means (15) are constituted by two cylindrical half-shells (16) about the axis 00′, each including a semi-circular frame (18) on which the anodes (17) are fixed parallel to the axis 00′, said anodes (17) being surrounded on the outside by hollow tubes (21) parallel to 00′ and interconnected by hollow conduits (22) which are likewise semi-circular in shape and which are fed with compressed gas, the conduits (22) and the frames (18) being fixed to one another by insulators (23), and the tubes (21′) and the conduits (22) being fitted with nozzles (26, 27) which eject compressed gas in horizontal directions at angles close to 45° with the horizontal lines joining the respective nozzles (26, 27) to the axis 00′.

3 Claims, 6 Drawing Figures

APPARATUS FOR DEPOSITING METAL ON THE RUBBING PARTS OF A TURBINE ROTOR

The present invention relates to apparatus for depositing metal on the rubbing parts of a turbine rotor.

BACKGROUND OF THE INVENTION

Turbine rotors operating at high temperatures must be made of creep-resistant steel.

Steel containing 9% to 14% chrominum have good creep resistance but tend to seize. This tendency can give rise to operating defects in any of the parts of the rotor which are in direct contact with fixed parts, i.e. the inner or outer bearing surfaces of the bearings, and the bearing surfaces of the end stops, if any.

In order to prevent seizure phenomena and to improve the coefficient of friction, it is known to cover the rubbing parts with plates and shells of steel having a good coefficient of friction, as indicated in published European patent specification No. EU-A-68492.

However, the properties of such rotors may change in service. If the plates or the shells are fixed on by means of bolted assembles within the rotor itself, risks stem from stress concentrations at the bolts and, in particular, at their threads. If the plates or the shells are welded on, risks stem from degradation in the mechanical qualities of the rotor steel where it has been heated by the welding, which degradation is practically irreversible.

In accordance with the invention, a metal coating (preferably of chromium) is electrolytically deposited on the rubbing parts of the rotor.

The apparatus for depositing the metal enables very low coefficients of friction to be attained because of the uniformity of the deposited coating.

European published patent specification No. EU-A-37033 describes apparatus for depositing a metal coating on the hub of a rotor disk, said apparatus comprising a vat having a vertical axis 00′ constituted by a cylindrical portion terminated by a conical portion, said vat being filled with electrolyte, first means disposed near the top of said vat for feeding the vat with electrolyte, second means situated at the bottom of the vat for emptying the electrolyte, third means situated between the second means and the first means for regenerating and circulating the electrolyte, fourth means for supporting a curtain of anodes made of the metal to be deposited and for rotating the electrolyte about the axis 00′, and fifth means for applying current of given polarity to the curtain of anodes.

SUMMARY OF THE INVENTION

In the prior art device, the electrolyte is driven centrifugally by the fourth means to come and be deposited on the hub. In the apparatus according to the invention, the electrolyte must be centripetally driven in order to come and be deposited on the rubbing parts of the rotor situated about the axis 00′. In apparatus according to the invention enabling this result to be attained, said fourth means are constituted by two cylindrical half-shells about the axis 00′, each including a semi-circular frame on which the anodes are fixed parallel to the axis 00′, said anodes being surrounded on the outside by hollow tubes parallel to the axis 00′ and interconnected by hollow conduits which are likewise semi-circular in shape and which are fed with compressed gas, the conduits and the frames being fixed to one another by insulators, and the tubes and the conduits being fitted with nozzles which eject compressed gas in horizontal directions at angles close to 45° with the horizontal line joining the respective nozzles to the axis 00′.

In a preferred embodiment of the invention, the current is pulsed, thereby improving both the uniformity and the adherence of the deposited chromium.

BRIEF DESCRIPTION OF THE DRAWINGS

An embodiment of the invention is described by way of example with reference to the accompanying drawings, in which.

MORE DETAILED DESCRIPTION

Figure 1:
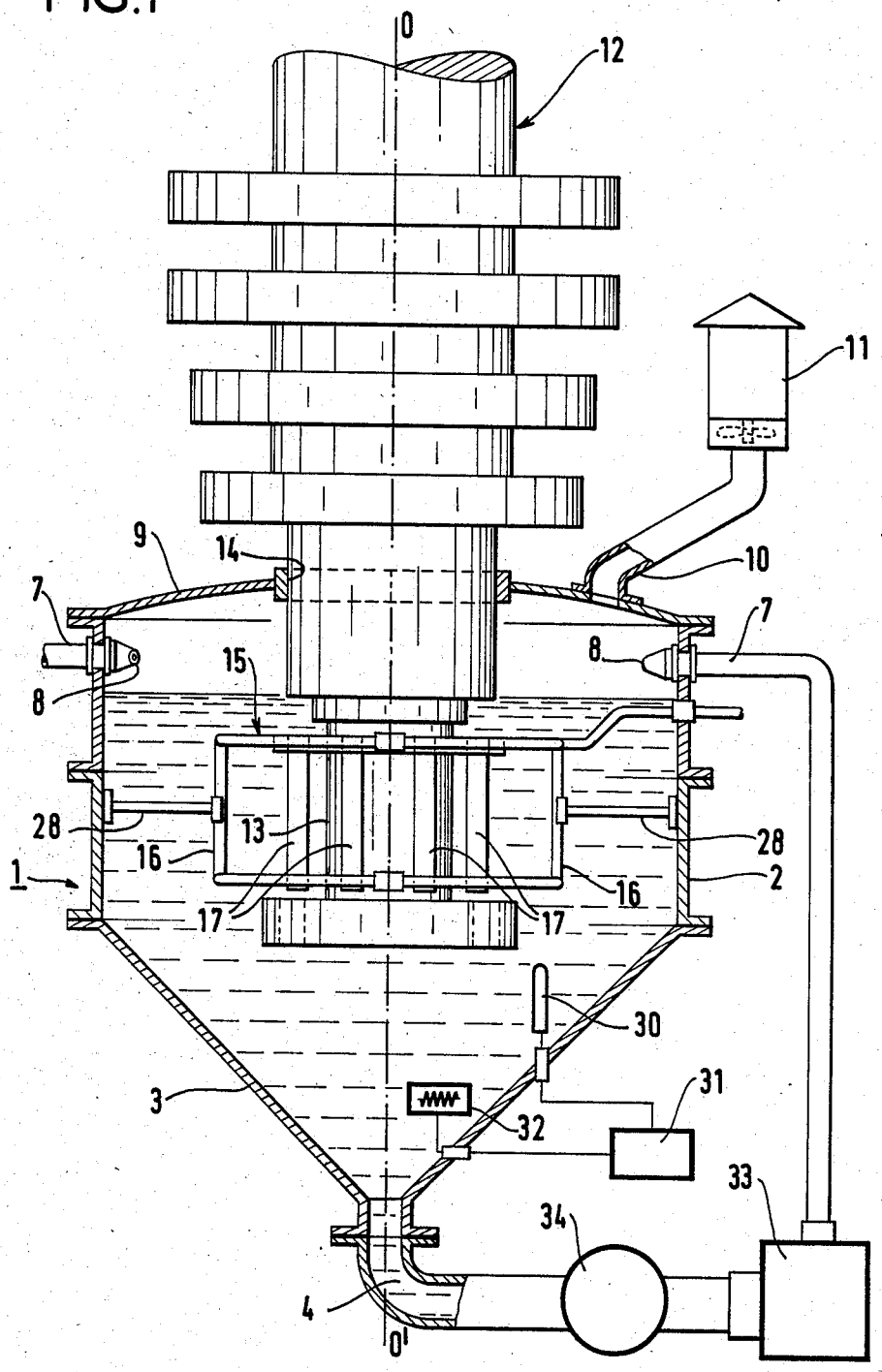
FIG. 1 shows apparatus in accordance with the invention.

Apparatus in accordance with the invention (see FIG. 1) comprises a vat 1 having a cylindrical portion 2 about a vertical axis 00′ and disposed above a conical portion 3 about the same axis. A quick-flush emptying system 4 is disposed at the bottom of the conical portion 3.

Two electrolyte feeds 7 are placed at 180° intervals at the top of the cylindrical portion 2.

The feeds 7 are terminated by nozzles 8 for injecting electrolyte horizontally and at angles of about 45° to the horizontal lines between each nozzle and the axis 00′.

The vat 1 has a cover 9 including a gas venting duct 10 which is fitted with a fan and a gas treatment unit 11.

The rotor 12 is suspended from its top end, and its bottom end including the rubbing parts 13 to be coated is situted in the vat 1. The cover 9 is made in two parts and includes a central opening 14 for clamping round the rotor 12.

Figure 2:
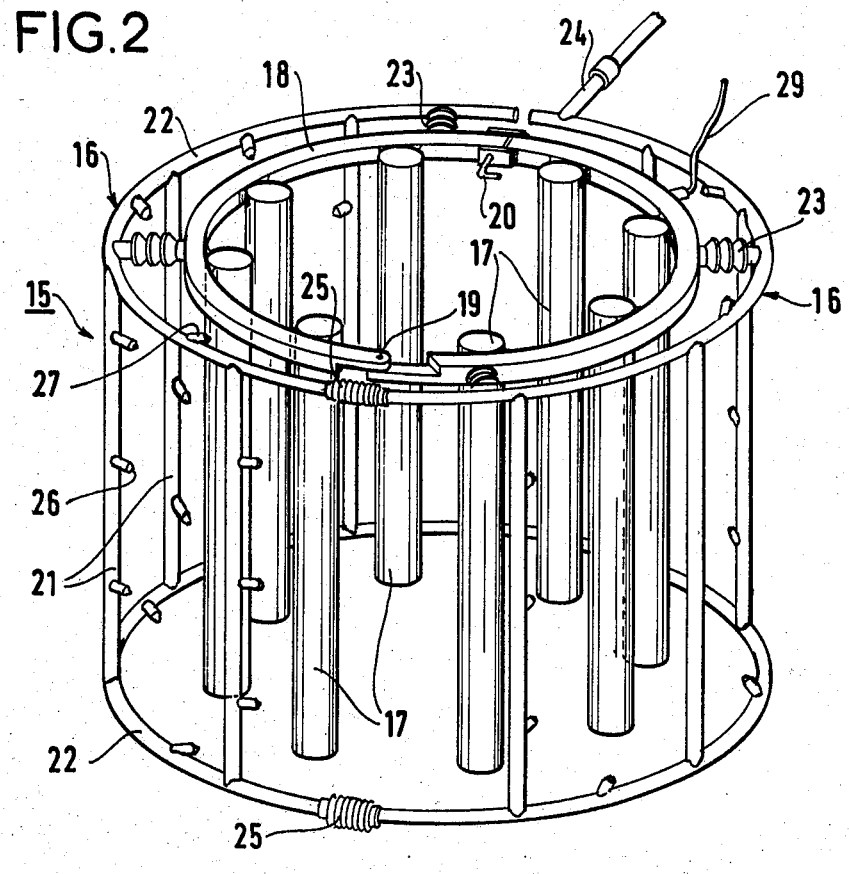
FIG. 2 shows a cage used in the apparatus.

The axis of the rotor 12 is aligned with the axis 00′. A cage 15 having the same axis 00′ is placed around the rubbing parts 13. The cage is constituted by two hinged half-shells 16 (see FIGS. 2, 3, and 4), each of which includes a curtain of anodes 17 lying parallel to the axis 00′ and fixed to two semi-circular frames 18 disposed at the top of the cage.

Figure 5:
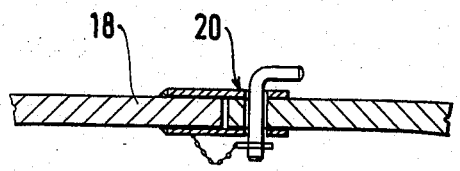
FIG. 5 shows the system for locking the FIG. 2 cage.

A hinge 19 is located at one end of each of the semi-circular frames, and locking means 20 for locking them together are located at their other ends (see FIG. 5).

Each half-shell 16 also includes tubes 21 which are parallel to the axis 00′ and which are interconnected by semi-circular conduits 22 at the top and at the bottom of the half-shells.

The top conduits 22 surround the frames 18 and are connected thereto by ceramic insulators 23.

The tubes 21 and the conduits 22 are hollow and in communication with one another. One of the conduits 22 is fitted with a compressed gas feed 24.

Figure 3:
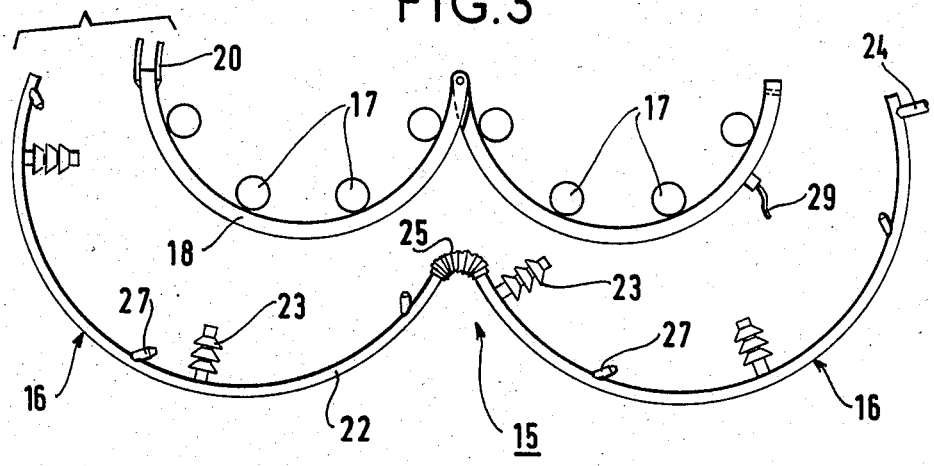
FIGS. 3 and 4 are plan views of the FIG. 2 cage in its open position and in its closed position.
Figure 4:
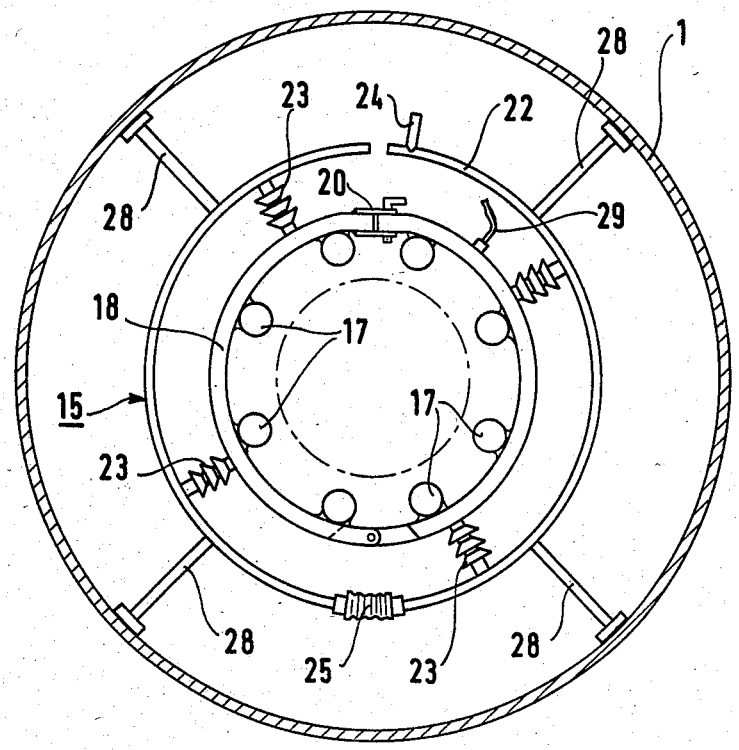

The top conduits 22 are interconnected by a flexible sleeve 25, as are the bottom conduits 22 (see FIG. 3).

The tubes 21 are fitted with nozzles 26 projecting compressed gas in horizontal directions which are at angles of substantially 45° to lines from the nozzles to axis 00′.

The conduits 22 are likewise fitted with nozzles 27. These nozzles 27 project compressed gas in horizontal directions which are at angles of substantially 45° to lines from the nozzles to the axis 00'.

The cage 15 is fixed to the vat 1 by spokes 28 (see FIG. 5). The cage assembly is symmetrical about the axis 00'.

A thermometer probe 30 is disposed inside the vat 1 and is connected to a generator 31. Whenever the electrolyte temperature departs by more than 1° C. from a set temperature, the generator delivers electricity to a heater resistance 32 situated at the bottom of the vat 1.

The electrolyte emptying system 4 and the feeds 7 are disposed in a circuit including a regenerator 33 for regenerating the electrolyte bath, a pumping system, and a valve 34. The circuit is used for injecting regenerated electrolyte either continuously or intermittently.

In order to deposit chromium, chromium anodes are selected together with a conventional chromic acid solution for the electrolyte. Certain sodium or calcium hydroxide salts may be added thereto in order to form tetrachromate salts.

Chromic acid could be replaced by trivalent chromium salts, thereby making it possible to use a simpler ventilation system.

Prior to treatment, the rotor is degreased, and its surfaces to be coated are hammered or shot blasted.

Once the rotor has been put into place, the vat is filled with electrolyte.

Because of the directions in which air and electrolyte are injected, the bath is driven in rotation around the axis 00'.

While the electrolyte is being emptied by the emptying system 4 and then reinjected via the feeds 7, the electrolyte additionally circulates from top to bottom.

A uniform deposit of trivalent chromium is obtained by superposing an alternating current (AC) on the positive direct current (DC), e.g. an AC in the form of one second pulses every twenty seconds with alternate pulses being of positive and of negative polarity and at an amplitude which is less than the DC. The deposited chromium has the desired hardness and both its yield and its adherence are improved.

The chromium disposed is 150 u to 200 u thick after surface lapping. The operation is completed by treatment in a degassing oven (180° C. to 210° C.).

Figure 6:
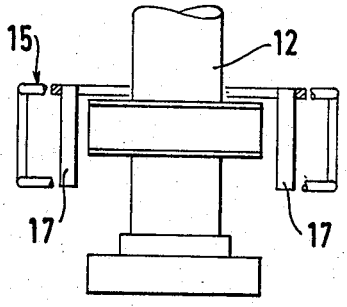
FIG. 6 shows the disposition relative to the FIG. 2 cage of a rotor having a stop.

The rubbing parts to be covered may be the inner surfaces of the bearings as shown in FIG. 1 or of the end stops as shown in FIG. 6. In both cases the anodes are disposed opposite the surface to be covered.

I claim:

1. Apparatus for depositing metal, said apparatus comprising:

a vat having a vertical axis 00' constituted by a cylindrical portion terminated by a conical portion, said vat being filled with electrolyte;

first means disposed near the top of said vat for feeding the vat with electrolyte;

second means situated at the bottom of the vat for emptying the electrolyte;

third means situated between the second means and the first means for regenerating and circulating the electrolyte;

fourth means for supporting a curtain of anodes made of the metal to be deposited and for rotating the electrolyte about the axis 00'; and fifth means for applying current of given polarity to the curtain of anodes;

said apparatus including the improvement whereby said fourth means are constituted by two cylindrical half-shells about the axis 00', each including a semi-circular frame on which the anodes are fixed parallel to the axis 00', said anodes being surrounded on the outside by hollow tubes parallel to said axis 00' and interconnected by hollow conduits which are likewise semi-circular in shape and which are fed with compressed gas, the conduits and the frames being fixed to one another by insulators, and the tubes and the conduits being fitted with nozzles which eject compressed gas in horizontal directions at angles close to 45° with the horizontal lines joining the respective nozzles to the axis 00'.

2. Apparatus according to claim 1, wherein the current applied to the anodes is pulsed.

3. Apparatus according to claim 1 or 2, wherein the deposited metal is chromium.

* * * * *